US009653277B2

(12) United States Patent
Yamaguchi

(10) Patent No.: US 9,653,277 B2
(45) **Date of Patent: *May 16, 2017**

(54) MASS SPECTROMETER

(75) Inventor: Shinichi Yamaguchi, Kyoto (JP)

(73) Assignee: Shimadzu Corporation, Kyoto (JP)

( * ) Notice: Subject to any disclaimer, the term of this patent is extended or adjusted under 35 U.S.C. 154(b) by 631 days.

This patent is subject to a terminal disclaimer.

(21) Appl. No.: 13/122,718

(22) PCT Filed: Oct. 9, 2008

(86) PCT No.: PCT/JP2008/002855

§ 371 (c)(1),
(2), (4) Date: Apr. 5, 2011

(87) PCT Pub. No.: WO2010/041296

PCT Pub. Date: Apr. 15, 2010

(65) Prior Publication Data

US 2011/0180705 A1 Jul. 28, 2011

(51) Int. Cl.
*H01J 49/00* (2006.01)
*H01J 49/40* (2006.01)

(52) U.S. Cl.
CPC ..... *H01J 49/408* (2013.01)

(58) Field of Classification Search
CPC ..... H01J 49/40; H01J 49/408
(Continued)

(56) References Cited

U.S. PATENT DOCUMENTS 7,355,168 B2 * 4/2008 Yamaguchi ..... 250/282
8,026,480 B2 * 9/2011 Yamaguchi et al. ..... 250/296
(Continued)

FOREIGN PATENT DOCUMENTS

JP 11-297267 10/1999
WO WO 2008/142737 A1 11/2008

OTHER PUBLICATIONS

Hisashi Matsuda, "Spiral Orbit Time of Flight Mass Spectrometer", J. Mass Spectrom. Soc. Jpn. vol. 48, No. 5, 2000, pp. 303-305.
(Continued)

*Primary Examiner* — Jason McCormack
(74) *Attorney, Agent, or Firm* — Morgan, Lewis & Bockius LLP

(57) ABSTRACT

A basic ion optical system having a guaranteed capability for the temporal focusing of ions, including sector-shaped electrodes, an injection slit and an ejection slit, is arranged on the same plane. Four or more sets of the basic ion optical systems are arrayed at predetermined intervals in a direction substantially orthogonal to the aforementioned plane. The injection slit on a topmost basic ion optical system plane and the ejection slit on a basic ion optical system plane located immediate below, as well as the injection slit on a bottommost basic ion optical system plane and the ejection slit on a basic ion optical system plane located immediate above, are respectively connected by another type of basic ion optical system having a guaranteed capability for the temporal focusing of ions. The other injection slits and ejection slits are respectively connected by another type of basic ion optical system having a guaranteed capability for the temporal focusing of ions. Thus, a loop orbit having a three-dimensionally deformed figure "8"-shape is formed, whereby the flight distance is elongated while ensuring the temporal focusing of the ions for the entire system, simultaneously with utilizing the three-dimensional space to compactify the ion optical system.

5 Claims, 8 Drawing Sheets

(58) Field of Classification Search
USPC ..... 250/281, 282, 287, 291, 296, 297
See application file for complete search history.

(56) References Cited

U.S. PATENT DOCUMENTS

| | | | | |
|---|---|---|---|---|
| 2004/0056190 | A1* | 3/2004 | Buttrill, Jr. | 250/287 |
| 2005/0247869 | A1* | 11/2005 | Yamaguchi | 250/287 |
| 2006/0163473 | A1* | 7/2006 | Vestal | 250/291 |
| 2006/0214100 | A1* | 9/2006 | Verentchikov et al. | 250/287 |
| 2006/0219890 | A1* | 10/2006 | Yamaguchi | 250/287 |
| 2007/0029473 | A1* | 2/2007 | Verentchikov | 250/281 |
| 2008/0006768 | A1* | 1/2008 | Yamaguchi | 250/287 |
| 2008/0210862 | A1* | 9/2008 | Yamaguchi et al. | 250/291 |
| 2009/0179150 | A1* | 7/2009 | Kovtoun et al. | 250/283 |
| 2009/0314934 | A1* | 12/2009 | Brown | H01J 49/408 250/282 |
| 2010/0140469 | A1* | 6/2010 | Nishiguchi | 250/287 |
| 2011/0248161 | A1* | 10/2011 | Takeshita et al. | 250/287 |

OTHER PUBLICATIONS

Takaya Satoh et al., "A New Spiral Time-of-Flight Mass Spectrometer for High Mass Analysis", J. Mass Spectrom. Jpn. vol. 54, No. 1, 2006, pp. 11-17.

Hisashi Matsuda, "Improvement of a TOF Mass Spectrometer with Helical Ion Trajectory", J. Mass Spectrom., Jpn. vol. 49, No. 6, 2001, pp. 227-228.

Japanese language international preliminary report on patentability dated Jun. 7, 2011 and its English language translation for corresponding PCT application PCT/JP2008/002855.

* cited by examiner

LOOP ORBIT WITH FOUR BASIC ION OPTICAL SYSTEM PLANES

LOOP ORBIT WITH EIGHT BASIC ION OPTICAL SYSTEM PLANES

MASS SPECTROMETER

CROSS-REFERENCE TO THE RELATED APPLICATIONS

This application is a national stage of international application No. PCT/JP2008/002855, filed on Oct. 9, 2008, the entire contents of which are incorporated herein by reference.

TECHNICAL FIELD

The present invention relates to a time-of-flight mass spectrometer, and more specifically to an ion optical system for forming a flight space in which ions are made to fly within a time-of-flight mass spectrometer.

BACKGROUND ART

Typically, in a time-of-flight mass spectrometer (TOF-MS), the time required for an ion to fly a certain distance is measured so as to calculate the mass of the ion from the time of flight, based on the fact that an ion accelerated by a certain amount of energy has a flight speed corresponding to its mass. Accordingly, increasing the flight distance is particularly effective for improving the mass resolving power. However, increasing the flight distance along a straight line is impractical because it inevitably leads to an increase in the size of the apparatus. To overcome this limitation, a variety of optical systems with different configurations for forming a flight space have been conventionally devised.

One example of such ion optical systems is a multi-turn system in which a closed loop orbit having a substantially elliptical shape or substantially figure "8"-shape is formed by using a plurality of sector-shaped electric fields (for example, refer to Patent Document 1 or other documents). In this system, the flight distance of ions can be increased by making them repeatedly fly along the loop orbit many times.

In the multi-turn time-of-flight mass spectrometer, it is necessary to prevent the deterioration of the sensitivity or resolving power due to a temporal or spatial dispersion of ions having the same mass (to be exact, mass-to-charge ratio m/z) during their flight through the loop orbit. To meet this demand, the ion optical system forming the loop orbit (an ion optical system forming the loop orbit is hereinafter simply referred to as an ion optical system) must not only satisfy the condition that its orbit is geometrically closed; it is also essential to prevent the peak from broadening on the time-of-flight axis after the flight through the loop orbit as well as the ion beam from dispersing after the flight through the loop orbit.

To meet such requirements, for example, in the multi-turn time-of-flight mass spectrometer disclosed in Patent Document 1, it is necessary to satisfy the temporal focusing condition that the time of flight of ions after the flight through the loop orbit should be independent of the initial position, initial angle and initial energy of the ions at the beginning of the flight. This requirement limits the shape and/or arrangement the sector-shaped electric fields forming the ion optical system. Such a system is not always easy to design.

The mass resolving power can be enhanced by increasing the number of turns through the loop orbit. However, when ions having different masses are mixed, an ion having a smaller mass and flying faster catches and overtakes another ion having a larger mass and flying more slowly, which makes it difficult to distinguish these ions. Accordingly, in order to enhance the mass resolving power, it is desirable to maximally elongate the one-turn length of the loop orbit so that no catching or overtaking of ions having different masses will occur. The elongation of the one-turn distance requires using a larger number of sector-shaped electric fields to form the ion optical system, increasing their radius of curvature, or elongating the length of the free-flight spaces. In the end, this also requires an enlargement of the installation area of the ion optical system.

One method for preventing the catching and overtaking of the ions on the loop orbit simultaneously with saving the installation area is to form a helical flight orbit. For example, in the apparatuses described in Non-Patent Documents 1 through 3, a loop orbit which is stable on a plane and capable of focusing ions having various kinds of spreads (or dispersion) is slightly shifted in the direction perpendicular to the plane to form a helical orbit. With this configuration, the focusing condition (particularly, the temporal focusing condition) of the ions is satisfied as long as the loop orbit lies on a plane. However, this does not absolutely guarantee that the focusing condition of the ions for the entire helical orbit will also be satisfied. Therefore, for example, it is possible that the sensitivity is deteriorated due to the dispersion of a portion of the ions or that the achieved mass accuracy or mass resolving power is lower than expected. Particularly, these problems are likely to occur when the number of turns is increased to elongate the flight distance.

Patent Document 1: JP-A H11-297267

Non-Patent Document 1: H. Matsuda, "Improvement of a TOF Mass Spectrometer with Helical Ion Trajectory," *Journal of the Mass Spectrometry Society of Japan,* 49, p. 227 (2001)

Non-Patent Document 2: H. Matsuda, "Spiral Orbit Time of Flight Mass Spectrometer," *Journal of the Mass Spectrometry Society of Japan,* 48, p. 303 (2000)

Non-Patent Document 3: T. Satoh et al., "A New Spiral Time-of-Flight Mass Spectrometer for High Mass Analysis," *Journal of the Mass Spectrometry Society of Japan,* 54, p. 11 (2006)

DISCLOSURE OF THE INVENTION

Problem to be Solved by the Invention

In view of the aforementioned problems, the present applicant has already proposed a novel ion optical system in the International Patent Application No. PCT/JP2007/000548 (International Publication No. WO/2008/142737). This ion optical system is composed a plurality of basic ion optical systems, each of which is formed by a plurality of sector-shaped electric fields and has a guaranteed capability for temporally focusing the ions. These basic ion optical systems are tandemly (or sequentially) placed on mutually separated planes, with the ion outlet of one basic ion optical system being connected to the ion outlet of another basic ion optical system by still another basic ion optical system having a guaranteed capability for temporally focusing the ions. This design enables not only an elongation of the flight distance while ensuring the temporal focusing of the ions for the entire system, but also an efficient use of the three-dimensional space to compactify the ion optical system.

The present invention is an improved version of the aforementioned ion optical system proposed by the present applicant, and its objective is to provide a time-of-flight mass spectrometer having an ion optical system that is easy to design and can be compactified while ensuring a long flight distance so as to achieve high levels of mass accuracy and mass resolving power.

Means for Solving the Problems

The present invention aimed at solving the aforementioned problem is a time-of-flight mass spectrometer for making ions fly in a flight space by giving a predetermined amount of energy to the ions, for temporally separating the ions according to their mass during their flight, and for detecting the separated ions with an ion detector. Its basic configuration is as follows: A plurality of basic ion optical systems are provided, each of which has an ion inlet, an ion outlet and a flight orbit on the same plane; the flight orbit is formed by an electric field inclusive of one or more sector-shaped electric fields in such a manner that an ion entering from the ion inlet will satisfy a temporal focusing condition at the ion outlet; the plurality of basic ion optical systems are sequentially connected in such a manner that the ion inlet of one basic ion optical systems is connected to the ion outlet of the basic ion optical system in the subsequent stage; and at least one of the basic ion optical systems is located on a plane different from a plane on which the basic ion optical system in either the previous or subsequent stage of the aforementioned one of the basic ion optical systems is located.

The mass spectrometer according to a first aspect of the present invention is a time-of-flight mass spectrometer for making ions fly in a flight space by giving a predetermined amount of energy to the ions, for temporally separating the ions according to their mass during their flight, and for detecting the separated ions with an ion detector, characterized in that:

a plurality of in-plane basic ion optical systems and a plurality of inter-plane basic ion optical systems are provided, each basic ion optical system having an ion inlet, an ion outlet and a flight orbit on a same plane, wherein the flight orbit is formed by an electric field inclusive of one or more sector-shaped electric fields in such a manner that an ion entering from the ion inlet will satisfy a temporal focusing condition at the ion outlet; and N sets of the in-plane basic ion optical systems are separately stacked at predetermined intervals (where N is an integer equal to or greater than two), and, among all the N sets of the in-plane basic ion optical systems, the ion outlet of one of the in-plane basic ion optical systems and the ion inlet of another one of the in-plane basic ion optical systems are connected by one of the inter-plane basic ion optical systems so as to create a loop-type orbit in which the N sets of the in-plane basic ion optical systems and the N sets of the inter-plane basic ion optical systems are alternately and sequentially connected.

The mass spectrometer according to a second aspect of the present invention is a time-of-flight mass spectrometer for making ions fly in a flight space by giving a predetermined amount of energy to the ions, for temporally separating the ions according to their mass during their flight, and for detecting the separated ions with an ion detector, characterized in that:

a plurality of in-plane basic ion optical systems and a plurality of inter-plane basic ion optical systems are provided, each basic ion optical system having an ion inlet, an ion outlet and a flight orbit on a same plane, wherein the flight orbit is formed by an electric field inclusive of one or more sector-shaped electric fields in such a manner that an ion entering from the ion inlet will satisfy a temporal focusing condition at the ion outlet;

N sets of the in-plane basic ion optical systems are separately stacked at predetermined intervals (where N is an integer equal to or greater than two), and, among all the N sets of the in-plane basic ion optical systems, the ion outlet of one of the in-plane basic ion optical systems and the ion inlet of another one of the in-plane basic ion optical systems are connected by one of the inter-plane basic ion optical systems, except the ion inlet or the ion outlet of the topmost in-plane basic ion optical system as well as the ion outlet or the ion inlet of the bottommost in-plane basic ion optical system, so as to create a basic unit having a linear orbit in which the N sets of the in-plane basic ion optical systems and the N−1 sets of the inter-plane basic ion optical systems are alternately and sequentially connected; and a loop-type orbit is formed by aligning the ion-beam axis at the ion outlet of the topmost in-plane basic ion optical system of one basic unit with the ion-beam axis at the ion inlet of the topmost in-plane basic ion optical system of another basic unit, and aligning the ion-beam axis at the ion outlet of the bottommost in-plane basic ion optical system of the aforementioned one basic unit with the ion-beam axis at the ion inlet of the bottommost in-plane basic ion optical system of the aforementioned another basic unit.

The mass spectrometer according to a third aspect of the present invention is a time-of-flight mass spectrometer for making ions fly in a flight space by giving a predetermined amount of energy to the ions, for temporally separating the ions according to their mass during their flight, and for detecting the separated ions with an ion detector, characterized in that:

a first basic ion optical system and a second basic ion optical system are provided, each basic ion optical system having an ion inlet, an ion outlet and a flight orbit on a same plane, wherein the flight orbit is formed by an electric field inclusive of one or more sector-shaped electric fields in such a manner that an ion entering from the ion inlet will satisfy a temporal focusing condition at the ion outlet; and a plane on which one set of the first ion optical system lies, and a plane on which another set of the first ion optical system located in the subsequent stage lies, are oriented so that these two planes make an orthogonal or an oblique angle, and the ion outlet of the aforementioned one set of the first ion optical system is connected to the inlet of the aforementioned another set of the first ion optical system by the second ion optical system.

In the mass spectrometer according to the third aspect of the present invention, it is possible to form a loop-type orbit by alternately and sequentially connecting three or more sets of the first basic ion optical systems and three or more sets of the second basic ion optical systems.

The state in which the temporal focusing condition is satisfied is a state in which the flight time of an ion is independent of the initial position, initial angle (direction) and initial energy of the ion. That is to say, any ions having the same mass (to be exact, the same mass-to-charge ratio ink) will eventually have the same time of flight even if they are varied in terms of these conditions.

In the mass spectrometer according to the first aspect of the present invention, N sets of the in-plane basic ion optical systems are separately stacked at predetermined intervals in the height direction, i.e. along the direction substantially orthogonal to the planes on which these basic ion optical systems lie. Similarly, in the mass spectrometer according to the second aspect of the present invention, N sets of the in-plane basic ion optical systems belonging to each basic unit are separately stacked at predetermined intervals in the height direction, i.e. along the direction substantially orthogonal to the planes on which these basic ion optical systems lie. Forming such a vertical array of the basic ion optical systems is effective for utilizing the space in the height direction to advantageously save the occupation space of the in-plane basic ion optical systems (i.e. in the plane on which these systems lie) and thereby minimize the installation area of the entire ion optical system.

In a preferable mode of the mass spectrometer according to the first aspect of the present invention:

N is an even number equal to or greater than four, and among the N sets of the separately stacked in-plane basic ion optical systems, either the ion inlet or the ion outlet of the in-plane basic ion optical system at the topmost level is connected to either the ion outlet or the ion inlet of the in-plane basic ion optical system at the level immediately below by one of the inter-plane basic ion optical systems, and either the ion inlet or the ion outlet of the in-plane basic ion optical system at the bottommost level is connected to either the ion outlet or the ion inlet of the in-plane basic ion optical system at the level immediately above by another one of the inter-plane basic ion optical systems; and the ion inlets and the ion outlets remaining open for connection by the inter-plane basic ion optical systems in the aforementioned four in-plane basic ion optical systems, as well as the ion inlet and the ion outlet of any other two second-neighboring in-plane basic ion optical systems, are connected so as to create a loop-type orbit in which the N sets of the in-plane basic ion optical systems and the N sets of the inter-plane basic ion optical systems are alternately and sequentially connected.

When an attempt is made to connect, by the inter-plane basic ion optical systems, two in-plane basic ion optical systems largely separated in the vertical direction among a large number of in-plane basic ion optical systems separately stacked in the height direction, the entire ion optical system will be large in size since the inter-plane basic ion optical systems designed for that purpose will normally occupy a large space and significantly bulge out in the plane direction. By contrast, in the previously described preferable configuration, the connection needs only to connect, in maximum, two second-neighboring in-plane basic ion optical systems with one in-plane basic ion optical system in between among the large number of in-plane basic ion optical systems separately stacked in the height direction, so that the space occupied by the inter-plane basic ion optical system will be minimized.

In the mass spectrometer according to the second aspect of the present invention, when a large number of in-plane basic ion optical systems are separately stacked in the height direction, two vertically (most) neighboring in-plane basic ion optical systems are connected via the inter-plane basic ion optical system. Such a configuration also minimizes the space occupied by the inter-plane basic ion optical system.

In the mass spectrometer according to the third aspect of the present invention, at least one set of the first basic ion optical system and another set of the first basic ion optical system located in the subsequent stage, which are connected to each other via the second basic ion optical system, are not parallel to each other; that is to say, they respectively lie on orthogonally or obliquely intersecting planes. This design is advantageous for effectively utilizing the space in the height direction to minimize the installation area of the entire ion optical system.

Effect of the Invention

With the mass spectrometers according to the first through third aspects of the present invention, a loop orbit that satisfies the condition for the temporal focusing of the ions while ensuring a long flight distance can be formed in a small space. Particularly, in these mass spectrometers, a large number of basic ion optical systems can be sequentially connected so as to realize a compact system while extremely elongating the one-turn length of the loop orbit. This enhances the mass accuracy and mass resolving power. The increase in the one-turn length widens the mass range within which no catching or overtaking of the ions occurs during their flight. The downsizing of the entire system, and particularly the reduction in its installation area, is easy to achieve. The entire ion optical system can be designed with a higher degree of freedom and by relatively easy design work, in which only the condition for the temporal focusing of the ions on a plane needs to be considered for the design of the size, shape, arrangement and other elements of the electrodes used for forming the sector-shaped electric fields.

EXPLANATION OF NUMERALS

1A, 1B, 1C, 1D . . . . Ion Optical System
2 . . . First Basic Ion Optical System
3 . . . Second Basic Ion Optical System
4 . . . Third Basic Ion Optical System
5 . . . Fourth Basic Ion Optical System
P1-P8 . . . Basic Ion Optical System Plane
11-14, 21-23 . . . Toroidal Sector-Shaped Electrode
15 . . . Ion Injection Slit
16 . . . Ion Ejection Slit

BEST MODES FOR CARRYING OUT THE INVENTION

Figure 6:
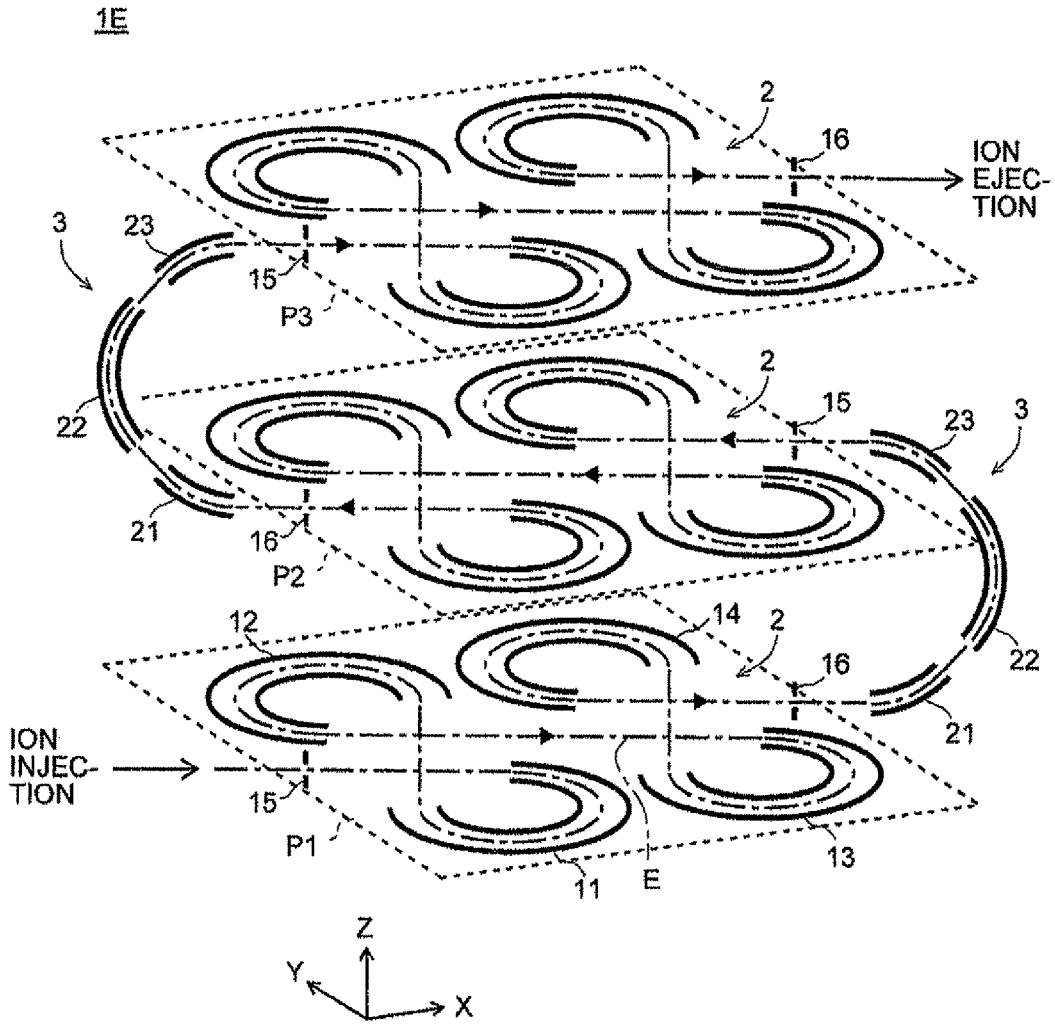
FIG. 6 is a schematic perspective view of an ion optical system relating to the present invention.
Figure 7:
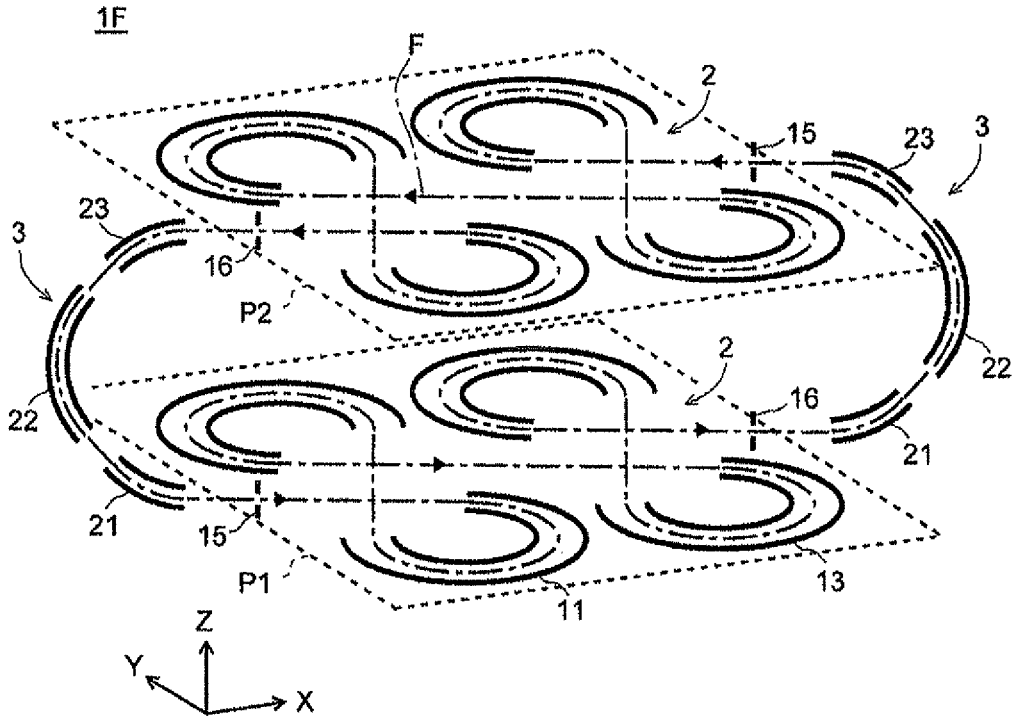
FIG. 7 is a schematic perspective view of another ion optical system relating to the present invention.
Figure 8:
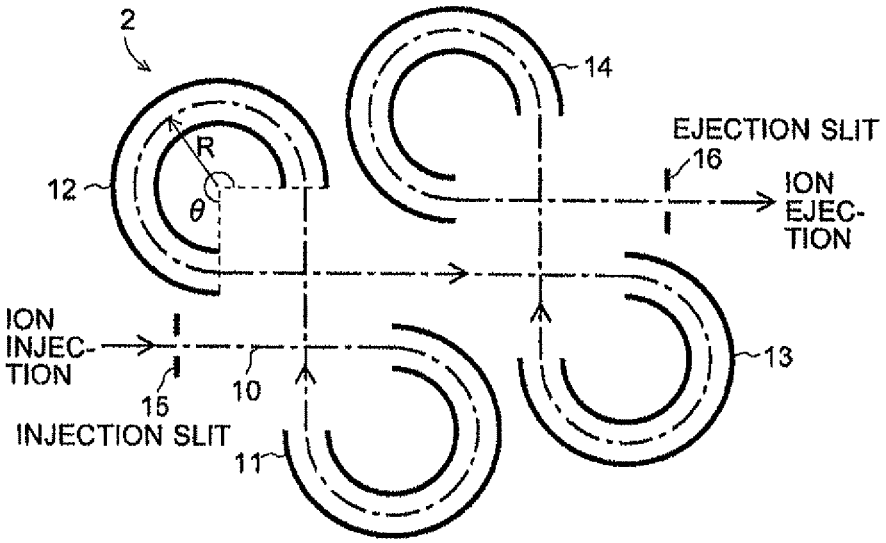
FIG. 8 is a plan view showing one example of a conventional linear-type ion optical system.
Figure 9:
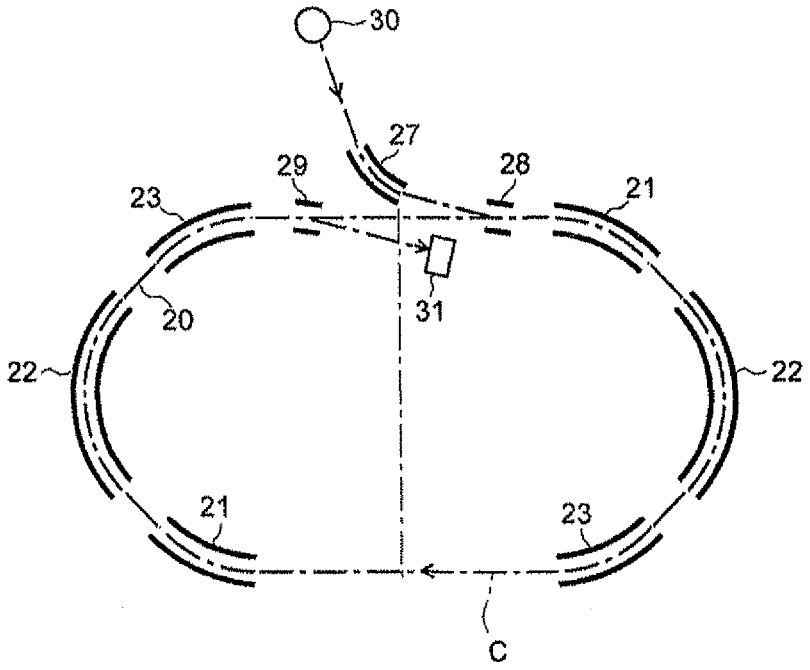
FIG. 9 is a plan view showing one example of a conventional loop-type ion optical system.

In advance of the explanation of embodiments of the mass spectrometer according to the present invention, examples of the aforementioned ion optical system proposed in the Internal Patent Application No. PCT/JP2007/000548 are hereinafter briefly described by means of FIGS. 6-9. FIGS. 6 and 7 are schematic perspective views of ion optical systems proposed in PCT/JP2007/000548. FIGS. 8 and 9 are plan views respectively showing conventional linear-type and loop-type ion optical systems.

The ion optical system 1E shown in FIG. 6 includes an array of three basic ion optical system planes P1, P2 and P3 spaced in the Z-direction. Each of these planes extends parallel to the X-Y plane, with a first basic ion optical system 2 formed thereon. The orbits on the basic ion optical system planes P1 and P2 as well as P2 and P3 neighboring in the Z-direction are connected by second basic ion optical systems 3.

The first basic ion optical system 2 is one example of the ion optical system described in T. Sakurai et al., "Ion Optics for Time-of-Flight Mass Spectrometers with Multiple Symmetry", *Journal of Mass Spectrometry and Ion Process,* 63, pp. 273-287 (1985), and other documents. As shown in FIG. 8, this system includes four pairs of toroidal sector-shaped electrodes 11, 12, 13 and 14, an ion injection slit 15, and an ion ejection slit 16. Each of the toroidal sector-shaped electrodes 11, 12, 13, and 14 is composed of an outer electrode paired with an inner electrode forming a central path (ion-beam axis) with radius R and deflection angle θ. The slit opening of the ion injection slit 15 corresponds to the ion inlet of the present invention, and the slit opening of the ion ejection slit 16 corresponds to the ion outlet of the present invention. The direction of injecting ions through the ion injection slit 15 and the direction of ejecting ions through the ion ejection slit 16 are identical (i.e. to the right in FIG. 8). The components and their arrangement of the first basic ion optical system 2 are each designed so that ions will be temporally focused at the ion ejection slit 16 in terms of the dispersion of the velocity, angle (direction), and energy of the ions at the ion injection slit 15. That is to say, any ions having the same mass will have the same time of fight. The ion injection slit 15 and the ion ejection slit 16 are completely interchangeable; the temporal focusing of the ions is guaranteed even if the ion ejection slit 16 is used as the ion inlet and the ion injection slit 15 as the ion outlet. Accordingly, no problem occurs even if the ion ejection slit 16 is used as the ion inlet and the ion injection slit 15 as the ion outlet.

The second basic ion optical system 3 utilizes one half of the loop orbit disclosed in Patent Document 1 and other documents. In the apparatus described in Patent Document 1, as illustrated in FIG. 9, an approximately elliptical loop orbit is formed by six pieces of toroidal sector-shaped electrodes 21, 22, 23, 24, 25 and 26, each field consisting of an outer electrode paired with an inner electrode. Ions ejected from an ion source 30 pass through a deflection electrode 27 and an injection electrode 28, to be injected into the loop orbit C. Ions flying along the loop orbit C are deviated from the orbit by an ejection electrode 29 and reach an ion detector 31. In this configuration, the temporal focusing of the ions is achieved in exactly one-half turn, i.e. through one half of the loop orbit including three pieces of toroidal sector-shaped electrodes 21, 22 and 23, or three pieces of toroidal sector-shaped electrodes 24, 25 and 26. In the mass spectrometer of the present embodiment, one set of three toroidal sector-shaped electric fields is used as the second basic ion optical system 3.

It should be naturally understood that a predetermined direct-current voltage is applied between the outer and inner electrodes of each toroidal sector-shaped electrode from a power supply (which is not shown) to form a sector-shaped electric field in the space between them.

As previously described, both the first and second basic ion optical systems 2 and 3 are designed to exhibit a guaranteed capability for temporally focusing the ions. Therefore, even in the case of FIG. 6 where a plurality (five in the example of FIG. 6) of ion optical systems are sequentially connected to form a linear flight orbit E, it is guaranteed that the ions injected from the ion injection slit 15 of the first basic ion optical system 2 in the initial stage on the basic ion optical system plane P1 will be temporally focused at the ion ejection slit 16 of the first basic ion optical system 2 in the last stage on the third basic ion optical system plane P3. Accordingly, while the flight distance is elongated to increase the mass resolving power, a high ion-passage ratio can also be achieved to ensure sufficient detection sensitivity.

Vertically arraying the first basic ion optical system planes in the Z-direction is effective for utilizing the space in the vertical direction to compactify the ion optical system 1E. Typically, mass spectrometers tend to require a large installation area because ion optical elements are often two-dimensionally arranged. On the other hand, the aforementioned configuration minimizes the installation area and thereby enables the creation of a mass spectrometer that is more compact than any conventional products.

In the example of FIG. 6, the first basic ion optical system 2 and the second basic ion optical system 3 are sequentially connected to form a linear flight orbit. On the other hand, in the example of FIG. 7, the first basic ion optical system 2 and the second basic ion optical system 3 are differently used to form a loop-type flight orbit F. In this configuration, when the ion injection slit 15 on the basic ion optical system plane P1 is regarded as the start point, the second basic ion optical system 3 connected to the ion ejection slit 16 on the first basic ion optical system plane P2 in the second stage has its outlet connected to the ion injection slit 15 on the aforementioned basic ion optical system plane P1. Thus, a loop-type flight orbit having a guaranteed capability for temporally focusing the ions is formed.

Since this flight orbit F is closed, it is necessary to use additional electrodes, such as the deflection electrodes shown in FIG. 9, to introduce ions from outside into the orbit F or extract ions flying along the orbit F to the outside. Other conventional techniques for injecting and ejecting ions may also be used. For example, an aperture may be formed in one of the toroidal sector-shaped electrodes, in which case the ions can be injected or ejected through that aperture when no voltage is applied to that sector-shaped electrode.

Figure 1:
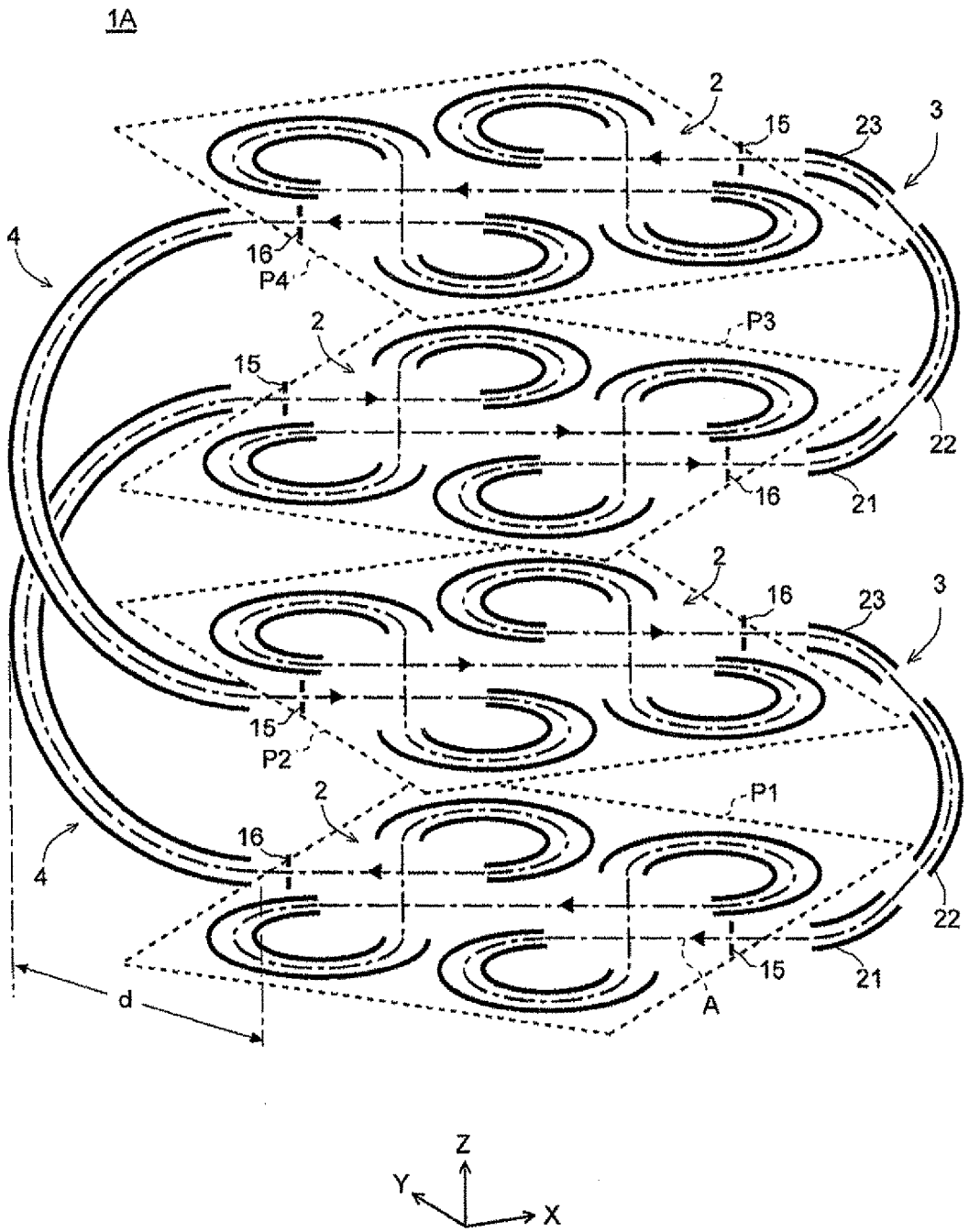
FIG. 1 is a schematic perspective view of an ion optical system of a time-of-flight mass spectrometer according to one embodiment of the present invention.

The approximate one-turn length of the ion optical system shown in FIG. 7 is given by the sum of the flight-path lengths of the two first basic ion optical systems 2 and the two second basic optical systems 3. In this case, it is possible to make the ions fly multiple times along the loop orbit F so as to elongate their flight distance and thereby enhance the mass resolving power. However, during the flight of the ions, a low-mass ion flying faster may catch up with and overtake a high-mass ion flying slower. If this occurs, two or more ions that have undergone different numbers of turns will be mixed, making it difficult to determine their mass from their time of flight. In the case of introducing ions with a certain range of mass into the loop orbit, it is desirable to use a loop orbit having the longest possible one-turn length so that the overtaking of the ions becomes less likely to occur during their flight. The one-turn length can be elongated by increasing the number of sequentially connected basic ion optical systems. Even in that case, it is essential to make the entire ion optical system as compact as possible. With reference to FIG. 1, an ion optical system 1A of the mass spectrometer according to one embodiment of the present invention, which is designed from the aforementioned point of view, is hereinafter described.

In FIG. 1, the components which are identical those shown in FIGS. 6-9 are denoted by the same numerals. The ion optical system 1A according to the present embodiment uses a basic unit including two basic ion optical system planes P1 and P2 arranged parallel to each other and spaced in the Z-direction, wherein each of these planes extends parallel to the X-Y plane, with the first basic ion optical system 2 formed on each plane, and the orbits of the two basic ion optical systems are connected by the second basic ion optical system 3. Two basic units of the same configuration are spaced in the Z-direction. (The two basic ion optical system planes included in the upper basic unit are denoted by P3 and P4.) The orbits on the respective upper basic ion optical system planes P2 and P4 in the two basic units are connected by a third basic ion optical system 4. Similarly, the orbits on the respective lower basic ion optical system planes P1 and P3 in the two basic units are connected by another third basic ion optical system 4. Similar to the second basic ion optical systems 3, the third basic ion optical systems 4 have a guaranteed capability for temporally focusing the ions. Each of the third basic ion optical systems 4 is composed of one toroidal sector-shaped electrodes. Alternatively, similar to the second basic ion optical systems 3, the third basic ion optical system 4 may be composed of a plurality of toroidal sector-shaped electrodes.

Figure 2A:
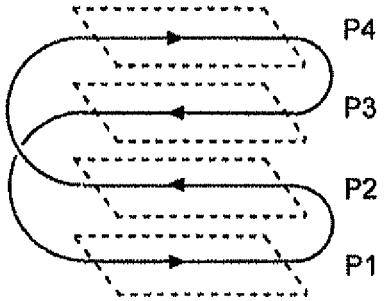
FIG. 2 is a conceptual diagram of the loop orbit of the ion optical system shown in FIG. 1 and the loop orbit of another ion optical system which is an extended version of that ion optical system.

Thus, in this ion optical system 1A, a loop orbit A with a guaranteed temporal focusing capability is formed by four sets of the first basic ion optical systems 2, two sets of the second basic ion optical systems 3, and two sets of the third basic ion optical systems 4. FIG. 2A schematically illustrates the form of this loop orbit A. This loop orbit A is shaped like a three-dimensionally deformed figure "8". In this configuration, the ion inlet and the ion outlet on the two basic ion optical system planes connected by the third basic ion optical system 4 relatively close to each other. To ensure the temporal focusing capability of the third basic ion optical system 4, it is necessary to use one or more toroidal sector-shaped electric fields. The larger the distance between the ion inlet and the ion outlet is, the larger the radius of the sector-shaped electric field must be. This means that the amount of bulge (as indicated by numeral d in FIG. 1) of the third basic ion optical system 4 in the direction parallel to the X-Y plane in the ion optical system 1A increases as the distance between the ion inlet and the ion outlet of the third basic ion optical system 4 increases.

For example, in the case of FIG. 6 where the structures each consisting of two vertically neighboring first basic ion optical systems 2 connected by a second basic ion optical system 3 are simply coupled in series, if the first basic ion optical systems 2 on the topmost and bottommost planes are connected by a third basic ion optical system 4, the amount of bulge d will be significantly large since the ion inlet and the ion outlet of the third basic ion optical system 4 are widely separated. By contrast, when the configuration of the ion optical system 1A in the previously described embodiment is adopted, the ion inlet and the ion outlet of the third basic ion optical system 4 are located close to each other, so that the amount of bulge d is small. Thus, the one-turn length of the loop orbit A can be elongated, while the area occupied by the ion optical system 1A on the X-Y plane is maximally decreased.

Figure 2B:
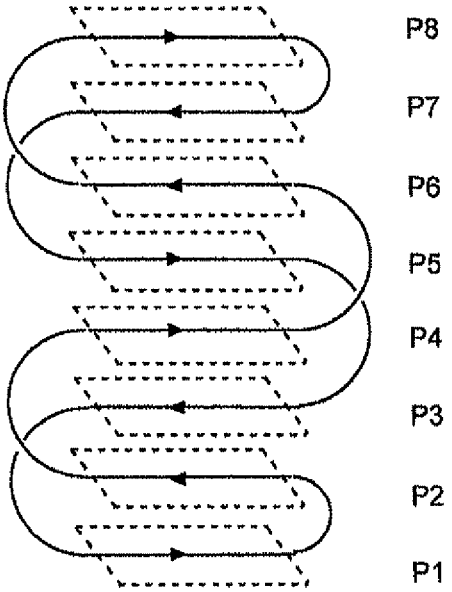

The configuration shown in FIG. 1, which has four basic ion optical system planes, can be extended to include any even number of planes greater than four. FIG. 2B schematically shows the shape of a loop orbit A with eight basic ion optical system planes arrayed in the Z-direction. In this configuration, the ion outlet on the topmost basic ion optical system plane and the ion inlet on the basic ion optical system plane located immediately below are connected by a second basic ion optical system. Similarly, the ion outlet on the bottommost basic ion optical system plane and the ion inlet on the basic ion optical system plane located immediately above are connected by another second basic ion optical system. The other ion inlets and ion outlets remaining on these four basic ion optical system planes, as well as the ion inlets and ion outlets of the other basic ion optical systems, are vertically connected by the third basic ion optical systems 4 in an interleaved fashion. As a result, a loop orbit which is shaped like a three-dimensionally deformed chain is obtained. Increasing the number of first basic ion optical systems 2 arrayed in the height direction (Z-direction) causes no in-plane expansion of the entire ion optical system. Thus, by adopting the configuration of the ion optical system according to the present embodiment, it is possible to create a compact ion optical system while ensuring a long one-turn length.

An ion optical system of a mass spectrometer according to another embodiment of the present invention is hereinafter described by means of FIG. 3. The ion optical system 1B in the present embodiment is composed of two basic units each of which includes four basic ion optical system planes P1-P4 arrayed in the Z-direction to form a layered structure. Among the first basic ion optical systems 2 lying on those basic ion optical system planes P1-P4, two vertically neighboring first basic ion optical systems 2 are connected by the second basic ion optical system 3. The topmost first basic ion optical system 2 has either an ion inlet or ion outlet, while the bottommost first basic ion optical system 2 has either an ion outlet or ion inlet. The ion-injecting direction and the ion-ejecting direction are opposite to each other.

The two basic units are mirror-symmetrically arranged with respect to a plane inclusive of the Z-axis and orthogonal to the injecting and ejecting directions of the ions. In FIG. 3, the four basic ion optical system planes in the left-side basic unit, which is mirror-symmetrical to the right-side basic unit, are denoted by P5-P8. An ion ejected from the ion outlet (ion ejection slit 16) of the topmost first basic ion optical system 2 in the left-side basic unit is injected into the ion inlet (ion injection slit 15) of the topmost first basic ion optical system 2 in the right-side basic unit. Similarly, an ion ejected from the ion outlet (ion ejection slit 16) of the bottommost first basic ion optical system 2 in the right-side basic unit is injected into the ion inlet (ion injection slit 15) of the bottommost first basic ion optical system 2 in the left-side basic unit. Thus, the two basic units are sequentially connected to form a loop orbit B.

Figure 3:
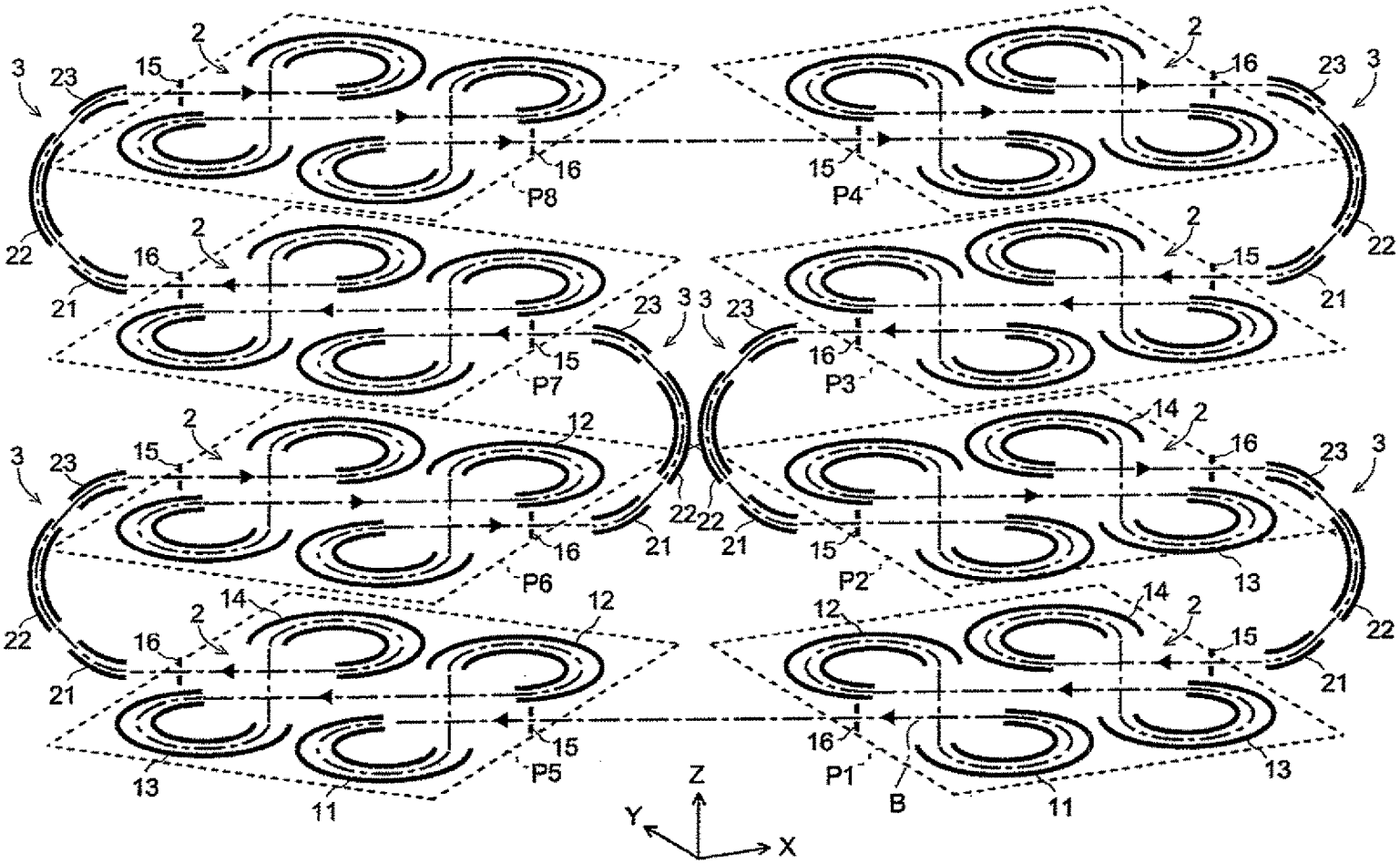
FIG. 3 is a schematic perspective view of an ion optical system of a time-of-flight mass spectrometer according to another embodiment of the present invention.

In the example of FIG. 3, each basic unit is formed by arraying four basic ion optical system planes in the Z-direction, or in the height direction. The number of these planes may be any even number. It is possible to provided a larger number of basic ion optical system planes in a layered form to increase the one-turn length while effectively utilizing the space in the height direction.

Figure 4:
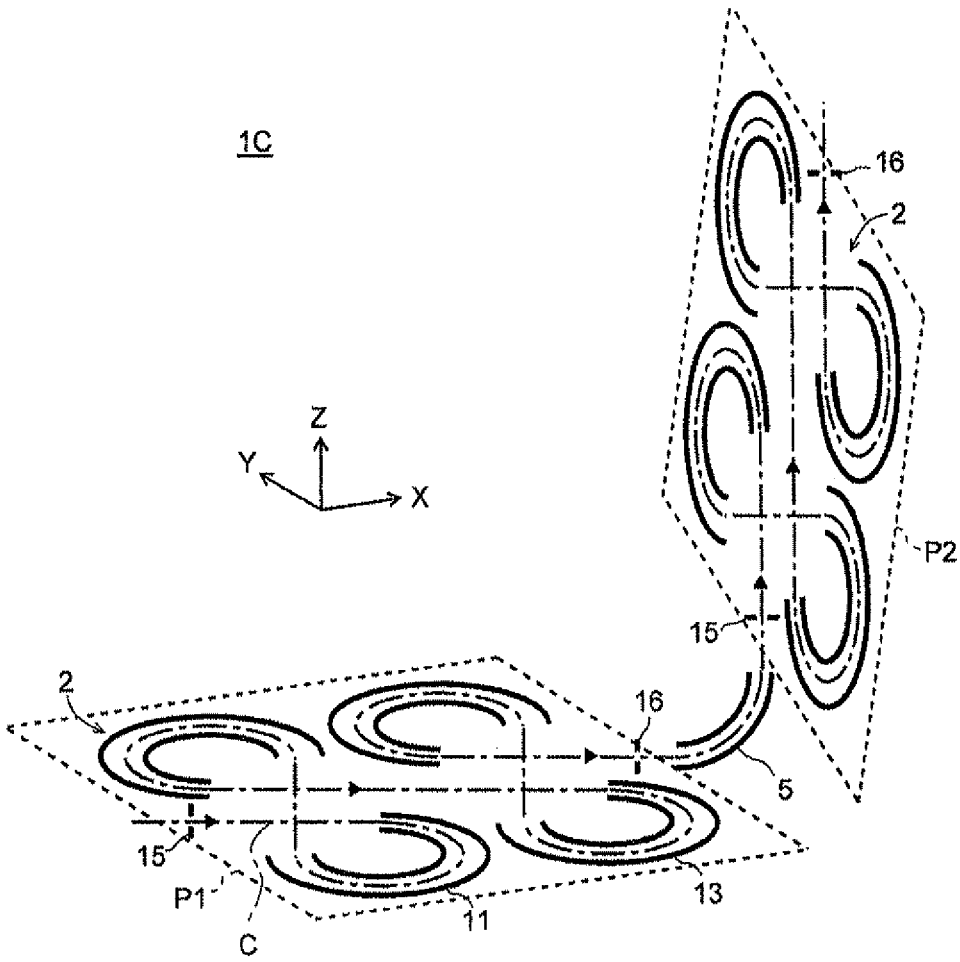
FIG. 4 is a schematic perspective view of an ion optical system of a time-of-flight mass spectrometer according to another embodiment of the present invention.
Figure 5:
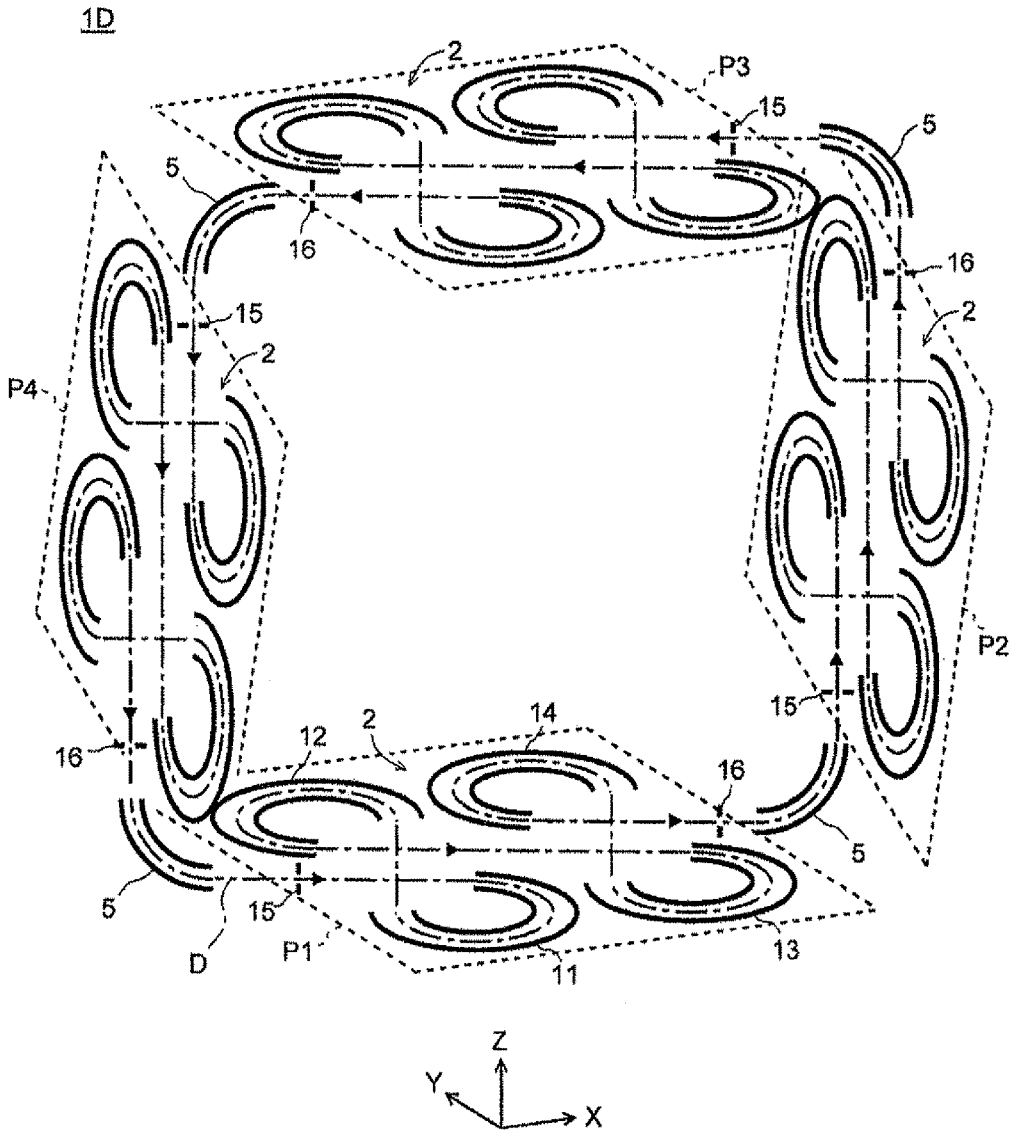
FIG. 5 is a schematic perspective view of an ion optical system of a time-of-flight mass spectrometer according to another embodiment of the present invention.

An ion optical system of a mass spectrometer according to still another embodiment of the present invention is hereinafter described by means of FIGS. 4 and 5. In the ion optical system 1C according to the present embodiment, the basic ion optical system plane P1, on which the first basic ion optical system 2 lies, is not parallel to but orthogonal to the other basic ion optical system plane P2, on which the first basic ion optical system 2 in the subsequent stage lies. The ion ejection slit 16 on the basic ion optical system plane P1 and the ion injection slit 15 on the basic ion optical system plane P2 are connected by a fourth basic ion optical system 5 having a guaranteed temporal focusing capability. The system shown in FIG. 4 is in the form of a linear flight orbit. This system can be sequentially connected, as shown in FIG. 5, to form a loop-type flight orbit.

In this manner, an ion optical system that effectively utilizes the space in the height direction can be constructed by arranging a portion of the basic ion optical system planes, with the first basic ion optical systems 2 lying thereon, orthogonally or obliquely to the X-Y plane (e.g. at an intersection angle of 60 degrees, 270 degrees and so on), rather than parallel to this plane.

It should be noted that the previously described embodiments are mere examples of the present invention, and any change, modification or addition appropriately made within the spirit of the present invention will naturally fall within the scope of claims of the present application. For example, any of the basic ion optical systems adopted in the previous embodiments is a mere example and may have any other configuration as needed.

The invention claimed is:

1. A time-of-flight mass spectrometer for making ions fly in a flight space by giving a predetermined amount of energy to the ions, for temporally separating the ions according to their mass during their flight, and for detecting the separated ions with an ion detector, comprising:

a plurality of in-plane basic ion optical systems and a plurality of inter-plane basic ion optical systems, each basic ion optical system having one ion inlet, one ion outlet and a flight orbit on a same plane, wherein the flight orbit is formed by a plurality of sector-shaped electric fields in such a manner that the ions entering from the ion inlet will turn 360 degrees or more, satisfying a temporal focusing condition at the ion outlet; and N sets of the in-plane basic ion optical systems separately stacked at predetermined intervals where N is an integer equal to or greater than two, wherein among all the N sets of the in-plane basic ion optical systems, the ion outlet of one of the in-plane basic ion optical systems and the ion inlet of another one of the in-plane basic ion optical systems are connected by one of the inter-plane basic ion optical systems so as to create a loop-type orbit in which the N sets of the in-plane basic ion optical systems and the N sets of the inter-plane basic ion optical systems are alternately and sequentially connected.

2. The mass spectrometer according to claim 1, wherein N is an even number equal to or greater than four, and among the N sets of the separately stacked in-plane basic ion optical systems, either the ion inlet or the ion outlet of the in-plane basic ion optical system at a topmost level is connected to either the ion outlet or the ion inlet of the in-plane basic ion optical system at a level immediately below by one of the inter-plane basic ion optical systems, and either the ion inlet or the ion outlet of the in-plane basic ion optical system at a bottommost level is connected to either the ion outlet or the ion inlet of the in-plane basic ion optical system at a level immediately above by another one of the inter-plane basic ion optical systems; and the ion inlets and the ion outlets remaining open for connection by the inter-plane basic ion optical systems in the aforementioned four in-plane basic ion optical systems, as well as the ion inlet and the ion outlet of any other two second-neighboring in-plane basic ion optical systems, are connected so as to create a loop-type orbit in which the N sets of the in-plane basic ion optical systems and the N sets of the inter-plane basic ion optical systems are alternately and sequentially connected.

3. The time-of-flight mass spectrometer according to claim 1, wherein among all the N sets of the in-plane basic ion optical systems, the ion outlet of one of the in-plane basic ion optical systems and the ion inlet of another one of the in-plane basic ion optical systems are connected by one of the inter-plane basic ion optical systems, except the ion inlet or the ion outlet of the topmost in-plane basic ion optical system as well as the ion outlet or the ion inlet of the bottommost in-plane basic ion optical system, so as to create a basic unit having a linear orbit in which the N sets of the in-plane basic ion optical systems and the N−1 sets of the inter-plane basic ion optical systems are alternately and sequentially connected; and a loop-type orbit is formed by aligning an ion-beam axis at the ion outlet of the topmost in-plane basic ion optical system of one basic unit with an ion-beam axis at the ion inlet of the topmost in-plane basic ion optical system of another basic unit, and aligning an ion-beam axis at the ion outlet of the bottommost in-plane basic ion optical system of the aforementioned one basic unit with an ion-beam axis at the ion inlet of the bottommost in-plane basic ion optical system of the aforementioned another basic unit.

4. The mass spectrometer according to claim 1, wherein the loop-type orbit is configured by the sector-shaped electrodes to form a three-dimensionally deformed figure eight.

5. A time-of-flight mass spectrometer for making ions fly in a flight space by giving a predetermined amount of energy to the ions, for temporally separating the ions according to their mass during their flight, and for detecting the separated ions with an ion detector, comprising:

a plurality of in-plane basic ion optical systems and a plurality of inter-plane basic ion optical systems, each basic ion optical system having one ion inlet, one ion outlet and a flight orbit on a same plane, each in-plane basic ion optical system comprising a plurality of toroidal sector-shaped electrodes for generating electric fields to form the flight orbit on the plane, wherein each toroidal sector-shaped electrode has a deflection angle of 270 degrees to deflect the ions to turn 360 degrees or more such that the flight distance is elongated while ensuring a temporal focusing condition at the ion outlet for the ions entering from the ion inlet; and N sets of the in-plane basic ion optical systems separately stacked at predetermined intervals where N is an integer equal to or greater than four, wherein among all the N sets of the in-plane basic ion optical systems, the ion outlet of one of the in-plane basic ion optical systems and the ion inlet of another one of the in-plane basic ion optical systems are connected by one of the inter-plane basic ion optical systems so as to create a loop-type orbit in which the N sets of the in-plane basic ion optical systems and the N sets of the inter-plane basic ion optical systems are alternately and sequentially connected.

* * * * *